US010482869B1

(12) United States Patent
Conlon et al.

(10) Patent No.: US 10,482,869 B1
(45) Date of Patent: Nov. 19, 2019

(54) SYSTEM AND METHOD FOR NOISE CANCELLATION IN EMERGENCY RESPONSE VEHICLES

(71) Applicant: WHELEN ENGINEERING COMPANY, INC., Chester, CT (US)

(72) Inventors: Brandon Conlon, Bristol, CT (US); David Dornfeld, Killingworth, CT (US)

(73) Assignee: WHELEN ENGINEERING COMPANY, INC., Chester, CT (US)

( * ) Notice: Subject to any disclaimer, the term of this patent is extended or adjusted under 35 U.S.C. 154(b) by 0 days.

(21) Appl. No.: 16/295,236

(22) Filed: Mar. 7, 2019

(51) Int. Cl.
*G10K 11/178* (2006.01)

(52) U.S. Cl.
CPC .... *G10K 11/178* (2013.01); *G10K 2210/1282* (2013.01)

(58) Field of Classification Search
CPC ..... G10K 11/178; G10K 2210/1281; G10K 2210/12; G10K 2210/128; G10K 2210/1282; G10K 2210/1283; H04R 2410/05
USPC ..... 381/71.1, 71.2, 71.4
See application file for complete search history.

(56) References Cited

U.S. PATENT DOCUMENTS

2009/0034746 A1* 2/2009 Nozaki ..... G10K 11/178 381/71.1
2013/0163774 A1* 6/2013 Maeda ..... G10K 11/178 381/71.4
2016/0027428 A1* 1/2016 Gul ..... H04R 27/00 381/71.4

* cited by examiner

*Primary Examiner* — George C Monikang
(74) *Attorney, Agent, or Firm* — Dilworth IP, LLC

(57) ABSTRACT

A system, method and storage medium for noise cancellation in a vehicle includes determining a waveform of a first sound wave at a first location, calculating another waveform of the first sound wave at a second location of an operator based on the waveform of the first sound wave at the first location and a first distance between the first location and the second location, generating at least one control signal based on the determined another waveform of the first sound wave at the second location, and generating a second sound wave based on the at least one control signal. A waveform of the second sound wave are formed to cancel out the first sound wave at the second location. The first sound wave is generated by a noise source.

25 Claims, 9 Drawing Sheets

SYSTEM AND METHOD FOR NOISE CANCELLATION IN EMERGENCY RESPONSE VEHICLES

TECHNICAL FIELD

This application relates to a system and method for noise cancellation in emergency response vehicles.

BACKGROUND

Sirens attached to emergency vehicles are used to inform neighboring vehicles an emergency situation. However, the long-term exposure of first responders to loud noise generated from the sirens may cause many severe medical issues such as deafness.

Thus, there is a need for a method and system to reduce the siren noise of emergency vehicles.

SUMMARY OF THE INVENTION

The objective of the present disclosure is to provide a system and method for effectively reducing or cancelling out a noise generated from the siren in an emergency vehicle. Aspects of the present disclosure are a system, method and storage medium for reducing or cancelling out a noise in an emergency vehicle.

In one aspect, there is provided a system for noise cancellation in a vehicle. The system includes a controller and a sound generator.

The controller is configured to determine a waveform of a first sound wave at a first location. The first sound wave is a noise sound generated from a noise source such as a siren attached to the vehicle. Based on the waveform of the first sound wave at the first location and a first distance between the first location and the second location, the controller is configured to calculate another waveform of the first sound wave which will arrive a second location where an operator is located. Further, the controller is configured to generate at least one control signal based on the determined another waveform of the first sound wave at the second location.

The at least one sound generator is positioned at a third location and is configured to generate a second sound wave based on the at least one control signal. The second sound wave, when being super-positioned with the first sound wave, acts to cancel out the first sound wave at the second location. To this end, at the second location, the amplitude and the frequency of the second sound wave are substantially the same as the amplitude and the frequency of the first sound wave, respectively, and the phase of the second sound wave is opposite to the first sound wave. For example, the sound generator is embodied with a speaker.

In one embodiment, the first location is where the noise source is located or in vicinity of the noise source. The waveform of the first sound wave at the first location (i.e., location of the noise source) are known to the system and are stored in memory. Thus, the controller is configured to read the information of the waveform of the first sound wave at the first location to determine the waveform of the first sound wave at the first location.

In one embodiment, the noise cancellation system further includes at least one sound receiver configured to detect the first sound wave at the first location as well as other measured locations throughout the vehicle and transmit the detected first sound wave to the controller. For example, the sound receiver is embodied with a microphone.

In order to cancel out the first sound wave at the second location, the waveform of the second sound wave generated from the sound generator is adapted in a manner to cancel out the first sound wave at the second location.

In one embodiment, the first sound wave can be a noise that should be reduced or cancelled out that is generated by the noise source.

In one embodiment, the noise source is positioned outside the vehicle (e.g., on top of the vehicle's roof), and the noise source is positioned at the first location which the controller determines the waveform of the first sound wave. For example, in this embodiment, no sound receiver (e.g., microphone) is needed to detect the first sound wave since the system has known the waveform of the first sound wave at the first location generated by the noise source.

In one embodiment, the system may include one or more optional sound receivers to detect the first sound wave at various locations to make it easier to determine the waveform of the first sound wave. In one example, a sound receiver can be positioned at the location which the noise source is positioned or in the vicinity of the noise source to detect the first sound wave output from the noise source. In another embodiment, the location at which the noise source is positioned at is not the same as the first location at which the controller determines the waveform of the first sound wave; for example, the noise source is positioned outside the vehicle, and the sound receiver is positioned at the first location inside the vehicle. Thus, the first sound wave generated from the noise source positioned outside the vehicle travels to the second location via the first location at which the waveform of the first sound wave are determined by the controller.

In one embodiment, the first location of the sound detector is positioned on a direct path of the first sound wave from the location of the noise source to the second location.

In one embodiment, the controller is configured to calculate the required waveform of the second sound wave at the third location of the sound generator. The second sound wave generated from the sound generator travels along a path from the third location to the second location, experiencing changes in at least amplitude, frequency, and/or phase over the path. The amount of the changes in amplitude, frequency, and/or phase of the second sound wave depends on a distance between the third location and the second location. Given that at the second location which the operator is positioned, the second sound wave is required to have the waveform to cancel out the first sound wave (as described above), the waveform of the second sound wave at the third location can be reversely calculated back from the target waveform of the second sound wave at the second location.

In one embodiment, the noise cancellation system further includes one or more sensors configured to scan a layout an interior of the vehicle and transmit information of the scanned layout to the controller. The controller is configured to determine the second location, the third location, and the fourth location based on the information of the scanned layout.

In one embodiment, the controller is configured to determine an angle at which the first sound wave generated from the noise source enters into a cabin of the vehicle through a surface (e.g., roof surface of the vehicle) and calculate the another waveform of the first sound wave at the second location based on the determined angle. For example, the angle is an angle at which a direction extending along a direct path between the location of the noise source and the second location of the operator crosses the surface of the vehicle which the first sound wave passes through.

In one embodiment, information regarding the angle may be stored in the memory, so that the controller reads the information of the angle from the memory.

In one embodiment, when the determined angle gets closer to 90 degrees with respect to the surface of the vehicle, the amplitude of the first sound wave after passing through the surface of the vehicle becomes increased and a frequency of the first sound wave perceived by the operator after passing through the surface becomes increased.

In one embodiment, when the determined angle gets farther away from the 90 degrees with respect to the surface of the vehicle, the amplitude of the first sound wave after passing through the surface of the vehicle becomes decreased and the frequency of the first sound wave perceived by the operator after passing through the surface becomes decreased.

In one embodiment, the frequency of the first sound wave perceived by the operator after passing through the surface of the vehicle is determined by a following equation:

$f_{perceived}=f_{actual}\cos(\theta)$, wherein $f_{perceived}$ is the frequency of the first sound wave perceived by the operator after passing through the surface, $f_{actual}$ is an actual frequency of the first sound wave before entering the surface, and $\theta$ is the determined angle.

In one embodiment, the first sound wave at the second location includes a directly transmitted portion and at least one reflected portion. The directly transmitted portion corresponds to the first sound wave transmitted directly from the first location without being reflected off a surface of the vehicle. The at least one reflected portion corresponds to the first sound wave reflected off at least one surface of the vehicle. Thus, the at least one control signal generated by the controller includes a first control signal and a second control signal. A portion of the second sound wave is generated based on the first control signal to cancel out the directly transmitted portion, and another portion of the second sound wave is generated based on the second control signal to cancel out the reflected portion.

In one embodiment, the first control signal is generated based on the first distance, and the second control signal is generated based on a distance of the travel path of the reflected portion of the second sound wave.

In another aspect of the present disclosure, there is provided a noise cancellation method for a vehicle. The method includes determining, by a controller, a waveform of a first sound wave at a first location; calculating, by the controller, another waveform of the first sound wave at a second location of an operator based on the waveform of the first sound wave at the first location and a first distance between the first location and the second location; generating, by the controller, at least one control signal based on the determined another waveform of the first sound wave at the second location; and generating, by a sound generator positioned at a third location, a second sound wave based on the at least one control signal.

In still yet another aspect of the present disclosure, there is provided a computer-readable storage medium having computer readable program instructions. The computer readable program instructions can be read and executed by at least one processor for performing a method for noise cancellation in a vehicle. The method includes determining a waveform of a first sound wave at a first location; calculating another waveform of the first sound wave at a second location of an operator based on the waveform of the first sound wave at the first location and a first distance between the first location and the second location; generating at least one control signal based on the determined another waveform of the first sound wave at the second location; and generating, using a sound generator positioned at a third location, a second sound wave based on the at least one control signal.

In one embodiment, the waveform of the second sound wave are formed to cancel out the first sound wave at the second location, and the first sound wave is generated by a noise source.

BRIEF DESCRIPTION OF THE DRAWINGS

The present disclosure will become more readily apparent from the specific description accompanied by the drawings.

DETAILED DESCRIPTION

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

For the sake of description, the present disclosure will be described with reference to a case where the noise cancellation system is used for an emergency vehicle as only an example. However, embodiments of the present disclosure are not limited thereto. It will be apparent that the noise cancellation system can be applied to any other vehicles or any space where the waveform of a noise sound wave is estimated.

Figure 1:
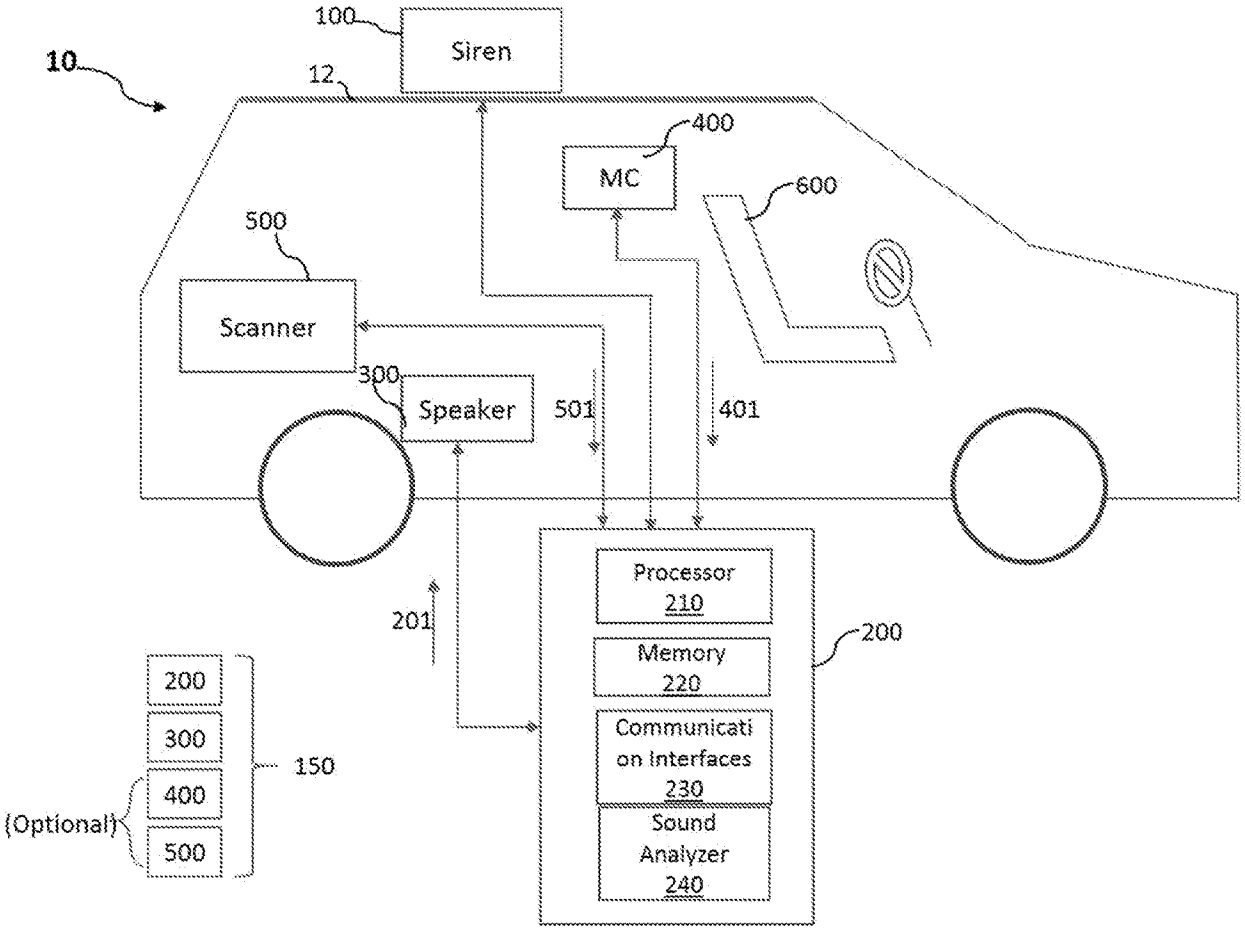
FIG. 1 is a block diagram of an example emergency vehicle having a noise cancellation system according to an embodiment of the present disclosure.

FIG. 1 is a block diagram of an example emergency vehicle (EV) 10 having a noise cancellation system 150 according to an embodiment of the present disclosure. The noise cancellation system 150 can be installed to be attached on an emergency vehicle 10 or in the vicinity thereof. The noise cancellation system 150 is configured to cancel out or reduce a noise (or noise sound wave) generated from a noise source 100 attached to a surface 12 of the vehicle 10 or in the vicinity thereof. In one embodiment, the noise source 100 can be a siren and attached on a top surface 12 of the vehicle 10, as exemplary depicted in FIG. 1. However, embodiments of the present disclosure are not limited thereto. For example, the noise source 100 can be an engine or any other elements generating noises.

Referring now to FIG. 1, the noise cancellation system 150 can include a control unit 200 and at least one speaker 300 in communication with the control unit 200. As shown in FIG. 1, the control unit 200 includes at least one processor 210 (e.g., central processing unit (CPU)), a memory 220 coupled to the processor 210, and a communication interface 230. For example, the control unit 200 is implemented using an arm cortex m4 microcontroller for the floating-point calculations, which allows increase of the calculation speed and reduce latency of the compensation sound wave being outputted from the speaker 300 to match the phase better. In some aspects, a real time operating system will also be used to manage the different tasks involved in this calculation and manage the required deterministic timing of the calculations.

Figure 2:
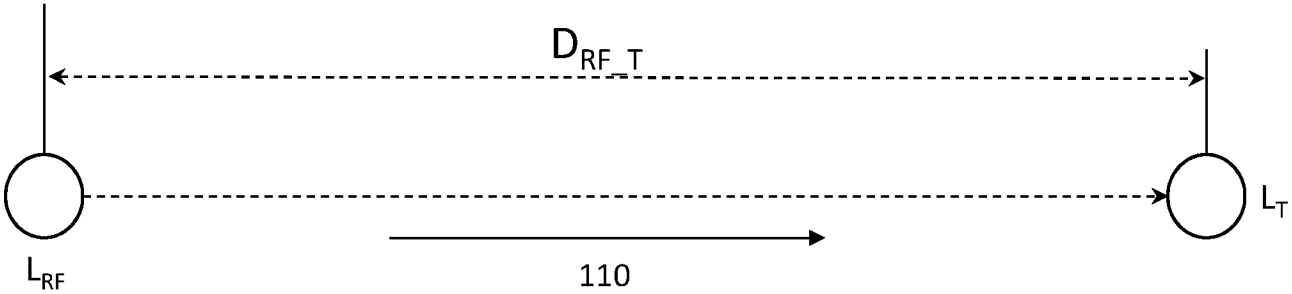
FIG. 2 is a view illustrating an example travel path of a sound wave between a reference location and a target location according to an embodiment of the present disclosure.

Referring further to FIG. 2, the control unit 200 estimates a waveform of the noise sound wave 110 arriving a target location $L_T$. The noise sound wave 110 at the target location $L_T$ is a wave which has been generated by the noise source 100 and transmitted over a certain path between the noise source 100 and the target location $L_T$, experiencing changes in amplitude, phase and/or frequency over the path. The control unit 200 generates a control signal 201 based on the estimated waveform of the noise sound wave 110 at the target location $L_T$ and transmit the control signal 201 to the speaker 300. The speaker 300 is configured to generate a compensation sound wave 310 based on the control signal 201 and transmit the compensation sound wave 310 to the target location $L_T$.

The target location $L_T$ is a location at which the system 150 wants to have the noise cancelled out. As exemplary depicted in FIG. 1, the target location $L_T$ can be at an operator (e.g., driver)'s ears or in the vicinity thereof. By way of example only, the target location $L_T$ can be set on a headrest of the operator's seat.

At the target location $L_T$, the compensation sound wave 310 has to have a waveform which acts to reduce or cancel out the noise sound wave thereat. Referring to FIG. 1, the compensation sound wave 310 that has to be generated from the speaker 300 can be calculated back based on a target waveform at the target location $L_T$ and a distance $D_{S_T}$ of the speaker 300 positioned at a location Ls away from the target location $L_T$. For example, at the target location $L_T$, the target waveform of the compensation sound wave 310 can have substantially the same amplitude and frequency as the estimated waveform of the noise sound wave 110, and the target waveform of the compensation sound wave 310 has an opposite phase to the estimated waveform of the noise sound wave 110 in order for the noise sound wave at the target location $L_T$ to be cancelled out or reduced.

The noise sound wave 110 arriving the target location $L_T$ may include a directly transmitted portion and one or more reflected portions. The directly transmitted wave corresponds to the noise sound wave transmitted directly from the noise source 100 to the target location $L_T$ without being reflected off any internal surface of the vehicle 10, and the reflected portion(s) correspond(s) to the noise sound wave reflected off at least one internal surface of the vehicle 10.

Here below is described a mechanism for cancelling out the directly transmitted portion at the target location $L_T$.

Cancellation of Directly Transmitted Portion of Noise Sound Wave

As described above, the waveform of the noise sound wave 110 arriving the target location $L_T$ have to be determined in order to allow the speaker 300 to generate a compensation sound wave which acts to reduce or cancel out the noise sound wave 110 at the target location $L_T$.

To that end, referring now to FIG. 2, the noise sound wave 110 at the target location $L_T$ can be calculated back by using a reference waveform of the noise sound wave 110 and a distance $D_{RF_T}$ between a location $L_{RF}$ and the target location $L_T$. The reference location $L_{RF}$ is a location where the reference waveform is determined. Further, for the sake of description, the reference waveform of the noise sound wave can hereinafter be referred to as a "reference waveform".

Figure 3A:
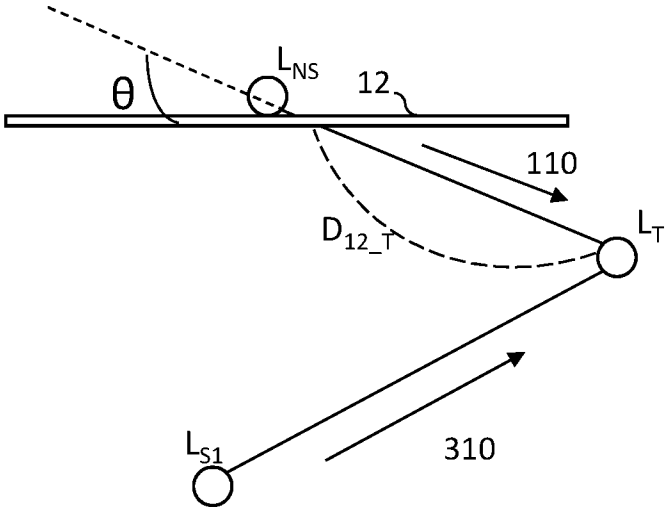
FIG. 3A is a view illustrating example travel paths of a noise sound wave and a compensation sound wave when a reference location is outside a vehicle according to an embodiment of the present disclosure.

In one embodiment, referring to FIG. 3A, the reference waveform may be a waveform of the noise sound wave at the location $L_{NS}$ of the noise source 100. In this case, as the location $L_{NS}$ is positioned outside the vehicle 10, the noise sound wave 110 may experience changes in amplitudes, frequencies and/or phases over a travel path from the location $L_{NS}$ to the target location $L_T$, a corresponding channel model of which is as conceptually depicted in FIG. 3B.

Figure 3B:
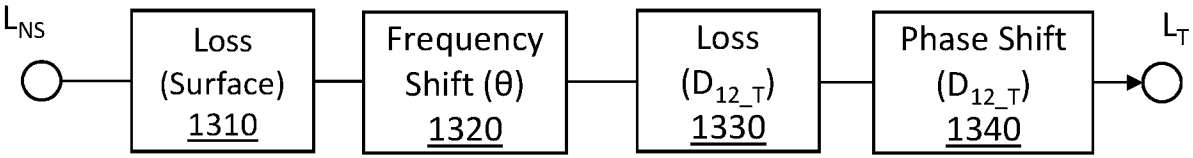
FIG. 3B is a view illustrating an example channel model of a noise sound wave in case of a reference location being outside a vehicle according to an embodiment of the present disclosure.

Referring now to FIG. 3B, a channel element 1310 is taken into account for a loss which the noise sound wave 110 undergoes when passing through a surface 12. A channel element 1320 is taken into account for a frequency change due to an angle θ at which the noise sound wave 110 enters into the cabin of the vehicle 10 through the surface 12. Channel elements 1330 and 1340 are taken into account for a loss and a phase change, respectively, during the noise sound wave traveling over a path with a distance (e.g., $D_{12_T}$). The loss of energy in a sound wave through a surface is due primarily to the reflection of said sound wave when crossing between materials of varying acoustic impedances.

For example, a percentage R of energy reflected back can be calculated by the following Equation (1):

$$R = \left(\frac{Z_2 - Z_1}{Z_2 + Z_1}\right)^2 \times 100 \quad \text{Equation (1)}$$

Here, $Z_1$ and $Z_2$ are impedances of the mediums that the sound waves are traveling through. For example, $Z_1$ represents an impedance of air, and $Z_2$ represents an impedance of a surface (e.g., door) of the vehicle 10 that the sound wave will have to pass through in order to enter the cabin. The equation (1) is called Fresnel's equation.

In the case of air and steel, which a car door is primarily comprised of, this reflection accounts for greater than 99 percent of the sound energy being reflected back to the source instead of being transmitted into the cabin. This varies from material to material 12 which may be made of e.g., metal. The entering angle θ of the noise sound wave may be measured by using locations of the noise source 100, an operator (e.g., target location $L_T$), the surface 12 of the vehicle 10, etc. When the angle θ gets closer to 90 degrees with respect to the surface 12 of the vehicle, the amplitude of the noise sound wave after passing through the surface 12 will become increased. In addition, when the angle θ gets farther from 90 degrees with respect to the surface 12 of the vehicle, the amplitude of the noise sound wave after passing through the surface 12 will become decreased.

Stokes's law of sound attenuation is $A(d)=A_0e^{-\alpha d}$ where d is a distance in meters $A_0$ is the initial amplitude of the sound and α is the attenuation of sound in that material.

In this example channel model of FIG. 3B, frequency phase shift, and a difference of attenuation of the sound wave through the surface of the vehicle 12 are neglected for the sake of simplicity.

The phase that the sound wave is currently in can then be calculated using t=x/v where t is equal to the time it takes a waveform to travel a distance x moving at a velocity v of the speed of sound 343 m/s.

Once t is known, $S_{NS}=A(d)\cos(w_{NS}t-\varphi_{NS})$ can be used to find the actual amplitude of the sound wave $S_{NS}$ at a point with attenuation being accounted for.

Here $A_{NS}$ is an amplitude, $w_{NS}$ is an angular frequency, and $\varphi_{NS}$ is the measured or known output phase.

Then, the waveform $S_T$ of the noise sound wave arriving the target location $L_T$ will be given as:

Referring again to FIG. 3B, the amplitude $A_T$ at the target location $L_T$ will be given by $\alpha\beta A_{NS}$, here α and β are losses corresponding to the channel elements 1310 and 1330, respectively. The frequency $W_T$ at the target location $L_T$ will be given by $w_{NS}\cos\theta$. The phase $\varphi_T$ at the target location $L_T$ will be given by $\varphi_{NS}+kD_{12_T}$, here k is a wave number. The wave number is given by λ/s, here λ is a wavelength and s is a speed of a sound wave (e.g., 340 meters/second). Thus, $\varphi_T=\varphi_{NS}+\lambda D_{12_T}/s$, here λ=s/f.

Referring back to FIG. 3A, in order to cancel out the directly transmitted portion of the noise sound wave 110, the compensation sound wave 310 at the target location $L_T$ has to be given by:

$$S_C=A_C\cos(w_Ct-\varphi_C) \quad \text{Equation (2)}$$

Here, at the location $L_T$, the amplitude $A_C$ and the frequency $w_C$ of the compensation sound wave 310 are substantially the same as those ($A_T$ and $W_T$) of the noise sound wave 110, and the phase $\varphi_C$ of the compensation sound wave 310 is opposite to the phase $\varphi_T$ of the noise sound wave 110 (e.g., $\varphi_C=-\varphi_T$). As described above, the control unit 200 calculates the compensation sound wave 310 that has to be generated from the speaker 300 based on the target waveform and a distance $D_{S1_T}$ of the speaker 300 away from the target location $L_T$, generates the control signal 201 based on the calculation, and transmits the control signal 201 to the speaker 300.

In one embodiment, the reference waveform of the noise sound wave at the location $L_{NS}$ (e.g., reference location) may be known to the system 150. For example, information of the noise sound waveform regarding amplitude, frequency and phase at the location $L_{NS}$ are stored in the memory 220 of the control unit 200. The control unit 200 may read such information of the reference waveform at the location $L_{NS}$ from the memory 220 and calculate the waveform change of the noise sound wave 110 over the path from the noise source 100 to the target location $L_T$, e.g., based on the channel model shown in FIG. 3B.

In one embodiment, the reference waveform of the noise sound wave at the location $L_{NS}$ can be measured by using at least one microphone. In one example, one or more microphones can be attached to the noise source 100, or positioned around the location $L_{NS}$ of the noise source 100. The measured reference waveform of the noise sound wave may be transmitted to the control unit 200 via the communication interfaces 230. The control unit 200 may have a sound analyzing module 240 for determining the characteristics (e.g., amplitude, frequency, and phase) of the noise sound wave transmitted from the microphone(s).

Figure 4A:
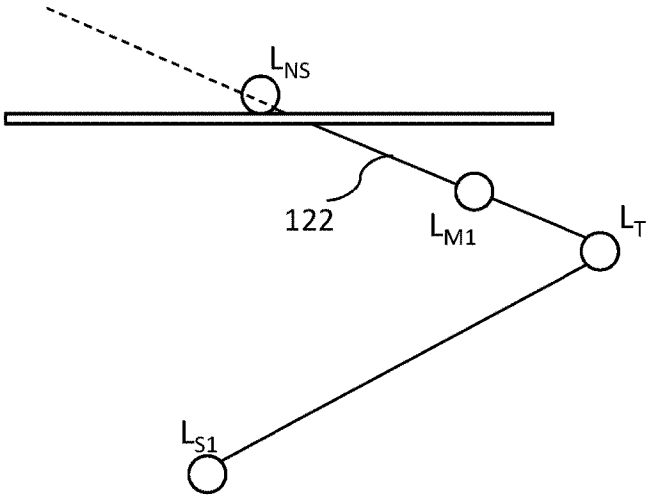
FIG. 4A is a view illustrating example travel paths of a noise sound wave and a compensation sound wave in case of a reference location being inside a vehicle according to an embodiment of the present disclosure.

In one embodiment, referring to FIG. 4A, the reference waveform can be a waveform at a location positioned inside the vehicle 10. For example, the reference waveform is measured by using at least one microphone positioned at a location $L_{M1}$ inside the vehicle 10. The microphone can be positioned in a direct path 122 from the noise source 100 to the target location $L_T$.

Figure 4B:
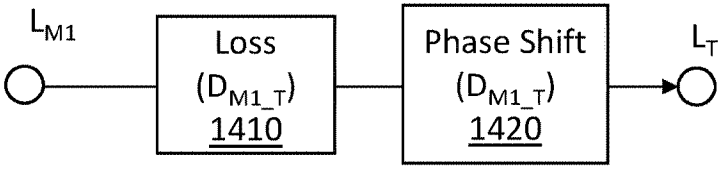
FIG. 4B is a view illustrating an example channel model of a noise sound wave in case of a reference location being inside a vehicle according to an embodiment of the present disclosure.

Depicted in FIG. 4B is an example channel model from the location $L_{M1}$ to the target location $L_T$. Referring to FIG. 4B, channel elements 1410 and 1420 are taken into account for a loss and a phase change, respectively, during the noise sound wave traveling over a path from the location $L_{M1}$ to the target location $L_T$ having a distance $D_{M1_T}$. As the microphone is positioned inside the vehicle 10, no consideration is made with regard to loss and frequency shift through the surface 12 which correspond to the channel elements 1310 and 1320, respectively.

Referring back to FIG. 1, the noise cancellation system 150 may further include at least one space scanner such as a time of flight sensor, sonar module, or camera's tracking for facial features located at specific positions to measure a layout of the interior of the vehicle and the position of the drivers ears 10 which allows the system 150 to be aware of positions of the microphone(s) (e.g., 400), the speaker 300, the target location $L_T$, the surfaces (e.g., 12 and 14), etc. The measured layout information of the interior of the vehicle 10 may be transmitted to the control unit 200 and/or stored in the memory 220.

Cancellation of Reflected Portion of Noise Sound Wave (Optional)

The noise sound wave 110 may travel over different paths than the direct path 122 toward the target location $L_T$, being reflected off one or more internal surfaces of the vehicle.

Since the cabin of a vehicle is typically less than tens of meters (e.g., less than 17 meters) long, the reflections of the noise sound wave off cabin's internal surface(s) may create a perceived lengthening of tones to the operator instead of an echo. The waveform of the reflected noise sound wave at the target location $L_T$ can be estimated by taking into account the paths over which the noise sound wave has to travel to reach the target location $L_T$.

The speaker 300 or at least one another speaker (not shown) may be used to generate a compensation sound wave to cancel out the estimated waveform of the reflected noise sound wave, as described above. Duplicate description will be omitted for the sake of simplicity.

Figure 5:
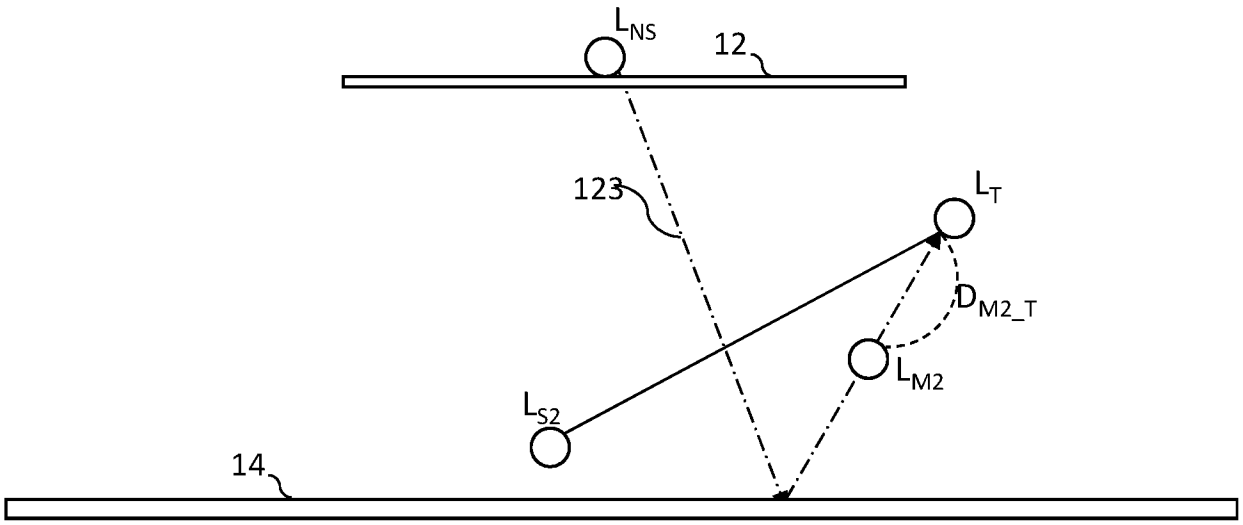
FIG. 5 is a view illustrating an example travel path of a reflected noise sound wave according to an embodiment of the present disclosure.

For the sake of explanation only, let us consider an example reflection path 123 which the noise sound wave will travel over, as shown in FIG. 5. The noise sound wave generated by the noise source 100 will pass through the surface 12, travels over an air path from the surface 12 to the surface 14, reflect off the surface 14, and travels over another air path from the surface 14 to the target location $L_T$.

Figure 6A:
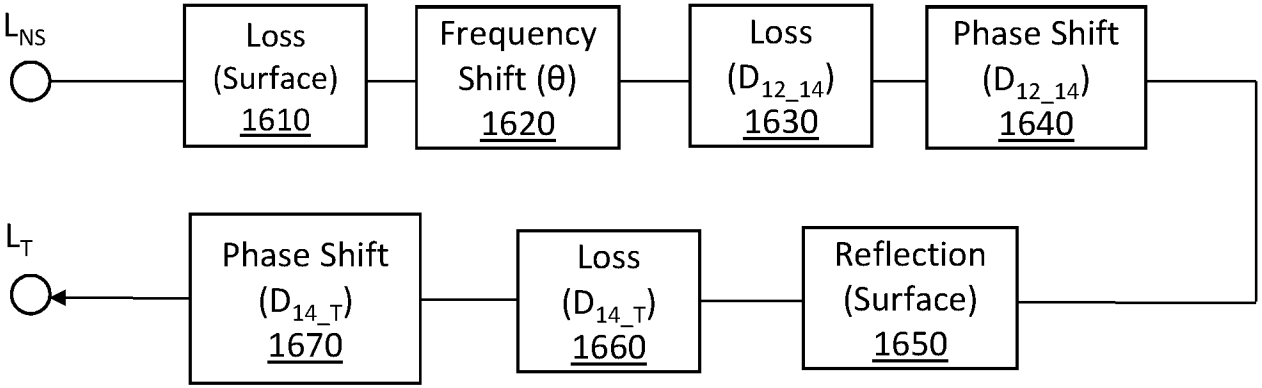
FIG. 6A is a view illustrating an example channel model of a noise sound wave in case of a reference location being outside a vehicle according to an embodiment of the present disclosure.

Depending on a location of the reference waveform of the noise sound wave 110, a channel model that has to be considered may vary. For example, if the reference location of the reference waveform is where the noise source 100 is positioned or near the noise source 100, the channel model may have to consider at least a loss through the surface 12 (see e.g., 1610 of FIG. 6A), a frequency shift through the surface 12 (see e.g., 1620 of FIG. 6A), a loss through the air path $D_{12_14}$ between the surface 12 and the surface 14 (see e.g., 1630 of FIG. 6A), a phase shift through the air path $D_{12_14}$ (see e.g., 1640 of FIG. 6A), an effect of reflection off the surface 14 (see e.g., 1650 of FIG. 6A), a loss through the air path $D_{14_T}$ between the surface 14 and the target location $L_T$ (see e.g., 1660 of FIG. 6A), and a phase shift through the air path $D_{14_T}$ (see e.g., 1670 of FIG. 6A). In order to consider the effect of the reflection off the surface 14, an angle at which the sound wave is reflected off the surface 14 and a material which the surface 14 is made of can be considered to determine the waveform change in e.g., amplitude, frequency and phase.

Figure 6B:
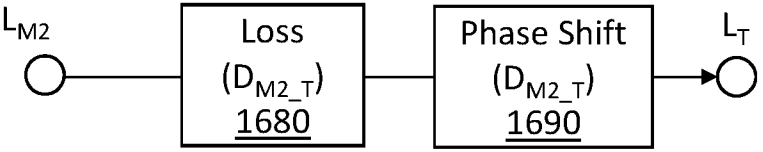
FIG. 6B is a view illustrating an example channel model of a noise sound wave in case of a reference location being inside a vehicle according to an embodiment of the present disclosure.

In addition, if the reference location of the reference waveform is where a microphone is positioned, as depicted in an example embodiment of FIG. 5 (for example, the microphone is positioned at a location $L_{M2}$ on a travel path between the last reflection surface 14 and the target location $L_T$), the channel model may only consider the loss through the air path $D_{14_T}$ between the surface 14 and the target location $L_T$ (see e.g., 1680 of FIG. 6B) and the phase shift through the air path $D_{14_T}$ (see e.g., 1690 of FIG. 6B), as depicted in FIG. 6B.

Practically, due to large numbers of surfaces in the vehicle cabin between a noise source 100 and the target location $L_T$, there may be a lot of different reflection paths of the noise sound wave other than the example path 123 of FIG. 5, which may cause the calculation for the resultant waveform of the noise sound wave at the target location $L_T$ to be harder. For example, this can be addressed by testing different kinds of vehicles with different placements of microphones and/or different frequencies of the noise sound wave so as to find out dominant reflection paths of the noise sound wave and optimal locations of microphones to calculate the waveform of the noise sound wave at the target location $L_T$.

As described above, the noise cancellation system 150 can use at least one space scanner 500 such as a time of flight sensor or sonar module to map out a layout of the interior of the vehicle 10 which allows the system 150 to be aware of positions of the microphones (e.g., 400), the speaker 300, the target location $L_T$, the surface (e.g., 12 and 14), etc. The measured information of the interior of the vehicle 10 can be used to estimate distances among the locations at interest or amount of time which it will take for the reflected sound to reach the target location $L_T$.

In one embodiment, in order to reduce these reflections of the noise sound wave off the surfaces as well as the leakage of noise sound wave into the vehicle cabin, one or more internal surfaces (e.g., 12 and 14) of the vehicle 10 can be made of a sound absorbing or dampening material such as porous material which is outfitted in the vehicle. The use of the sound absorbing or dampening material for the internal surfaces of the vehicle may make the estimation of the waveform of noise sound at the target location more predictable.

In one embodiment, the at least one speaker 300 can be provided as a stand-alone, or a part of the OEM sound system built in the vehicle. The speaker(s) can have the ability to outfit the vehicle interior with a noise absorbing material to reduce the reflections of the wave off itself.

In some aspects, the waveform of the noise sound wave 110 arriving the target location $L_T$ can be determined by leveraging an artificial intelligence (AI) platform based on machine learning algorithms. For example, instead of calculating the waveform of the noise sound wave at the target location, an AI-powered platform for testing different vehicle types with different placements of speakers and a range of frequencies outputted by the noise source can be used, so that various parameters of the AI platform such as weights of the equations between the nodes in a neural network can be trained so as to reduce the measured volume at a known distance from the noise source by a greatest amount throughout a range of frequencies.

Figure 9:
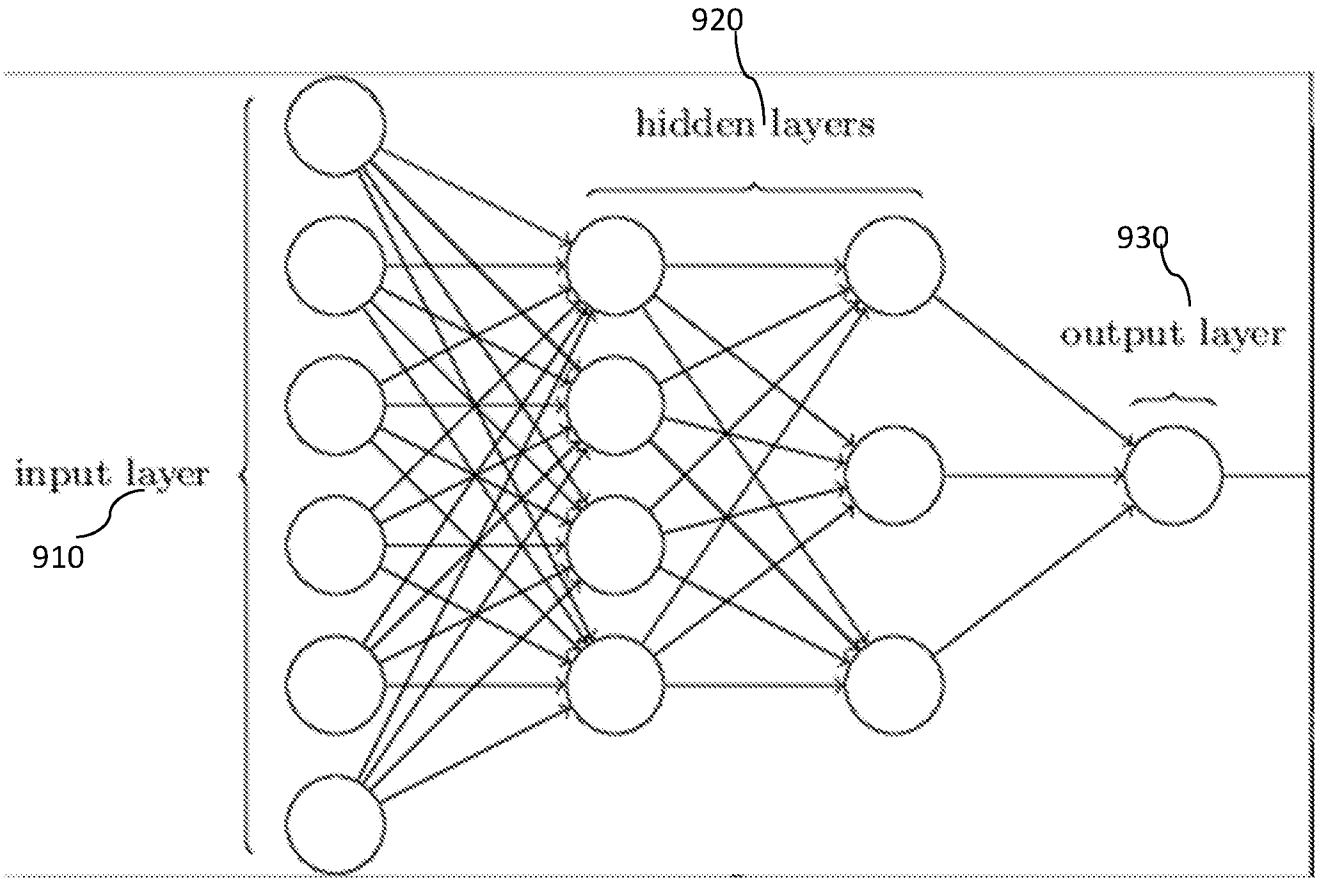
FIG. 9 is a view illustrating an example neural network with hidden layers used for training an artificial intelligence according to an embodiment of the present disclosure.

An example of a neural network with hidden layers used for training the AI platform is depicted in FIG. 9. For example, electronics (e.g., Omron Electronics B5T-007001-020) of a camera can be used to detect a person's face as well as its pitch. In combination with a second camera at a known distance and angle from the first this can be used to triangulate the position of the driver and each of their ears. This is one variable that can be plugged into the input layer 910 of the neural network of FIG. 9 along with the frequency amplitude phase and distance from the noise source as well as the vehicle the air is being trained on itself. The output layer 930 would then consist of only one output which is the decibel level within a narrow frequency around the outputted frequency of the siren at that time at the drivers ears which can be measured using a microphone. The hidden layer 920 of the AI then will vary the weights of the equations contained within it to minimize the decibel level within this narrow frequency band.

In some aspects, at least one microphone (not shown) can be placed around the vehicle 10 for measuring ambient noise. The ambient noise can be amplified and provided to the control unit 200. The information of the ambient noise can be used by the control unit 200 to allow the operator (e.g., police officer) monitor the surroundings of the vehicle or patrol for someone on foot.

Figure 7:
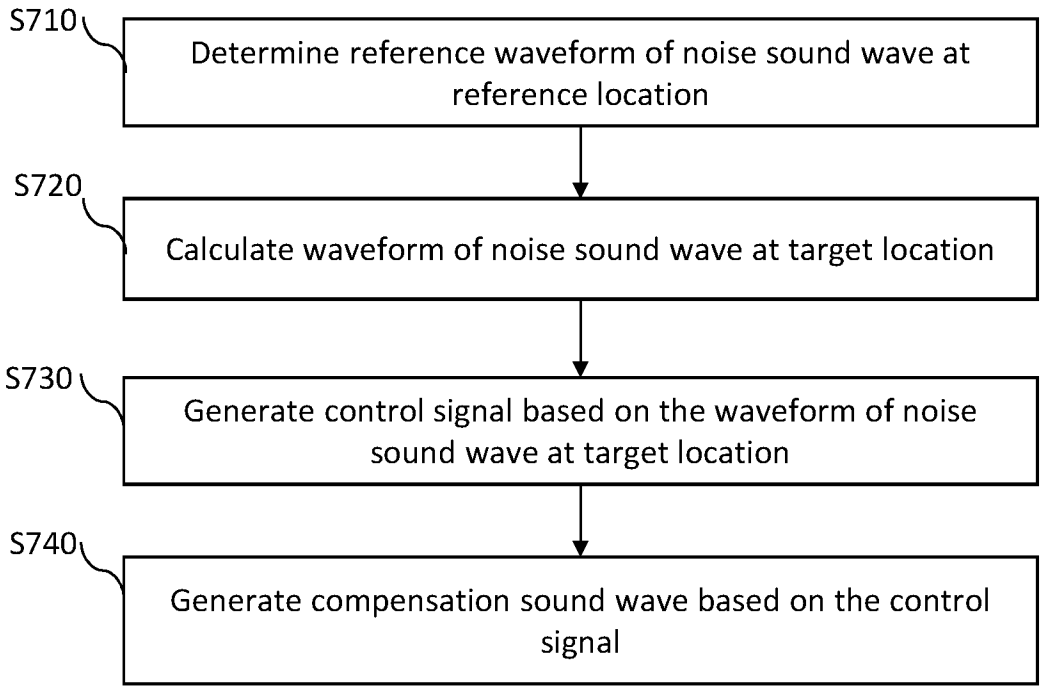
FIG. 7 is a flow chart illustrating a noise cancellation method according to an embodiment of the present disclosure.

FIG. 7 is a flow chart illustrating a noise cancellation method according to an embodiment of the present disclosure.

Referring now to FIG. 7, the method commences with step S710 of the control unit 200 determines the reference waveform of the noise sound wave 100 at a reference location $L_{RF}$.

In step S720, the control unit calculates a waveform of the noise sound wave at the target location based on the determined reference waveform and a distance between the reference location and the target location.

In step S730, the control unit generates the control signal 201 based on the waveform of the noise sound wave at the target location to transmit the control signal to at least one speaker 300.

In step S740, the speaker 300 generates the compensation sound wave based on the control signal to transmit the compensation sound wave to the target location.

Figure 8:
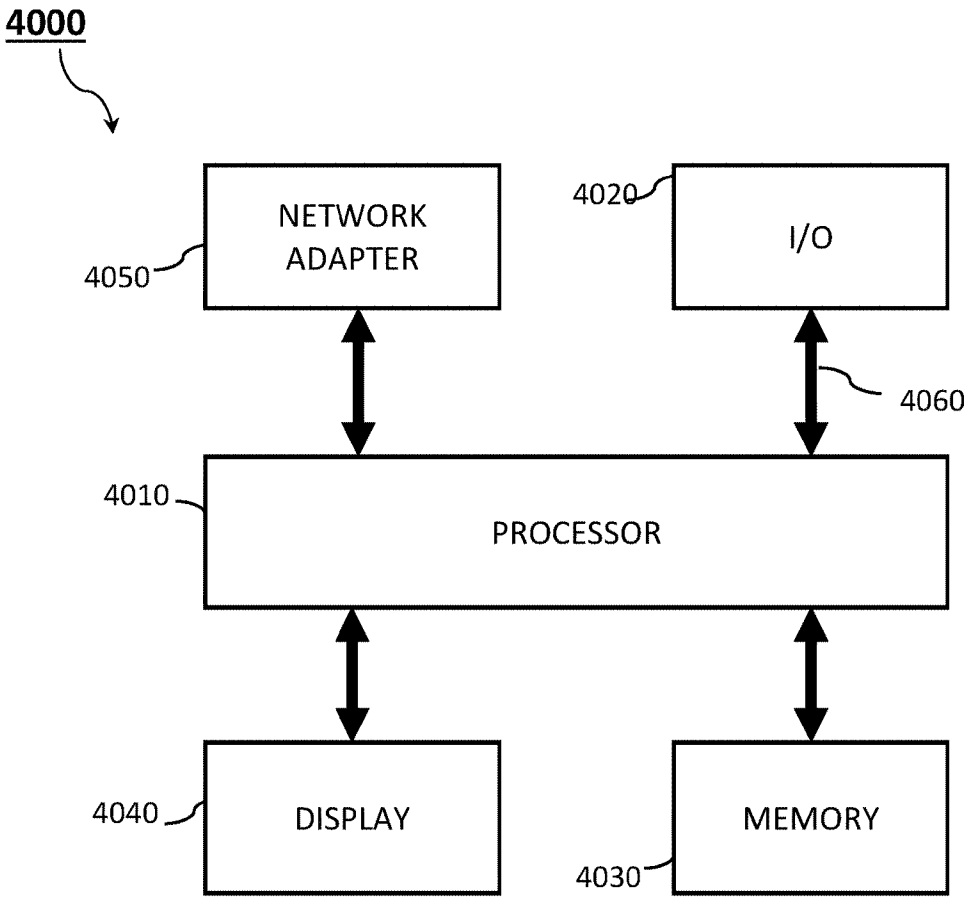
FIG. 8 is a block diagram of a computing system according to an embodiment of the present disclosure.

FIG. 8 is a block diagram of a computing system 4000 according to an exemplary embodiment of the present disclosure.

Referring to FIG. 8, the computing system 4000 may be used as a platform for performing: the functions or operations described hereinabove with respect to at least one of the noise cancellation system 150 of FIG. 1 and/or the method described with reference to FIG. 7.

Referring to FIG. 8, the computing system 4000 may include a processor 4010, I/O devices 4020, a memory system 4030, a display device 4040, and/or a network adaptor 4050.

The processor 4010 may drive the I/O devices 4020, the memory system 4030, the display device 4040, and/or the network adaptor 4050 through a bus 4060.

The computing system 4000 may include a program module for performing: the functions or operations described hereinabove with respect to at least one of the noise cancellation system 150 of FIG. 1 and/or the method described with reference to FIG. 7. For example, the program module may include routines, programs, objects, components, logic, data structures, or the like, for performing particular tasks or implement particular abstract data types. The processor (e.g., 4010) of the computing system 4000 may execute instructions written in the program module to perform: the functions or operations described hereinabove with respect to at least one of the noise cancellation system 150 of FIG. 1 and/or the method described with reference to FIG. 7. The program module may be programmed into the integrated circuits of the processor (e.g., 4010). In an exemplary embodiment, the program module may be stored in the memory system (e.g., 4030) or in a remote computer system storage media.

The computing system 4000 may include a variety of computing system readable media. Such media may be any available media that is accessible by the computer system (e.g., 4000), and it may include both volatile and non-volatile media, removable and non-removable media.

The memory system (e.g., 4030) can include computer system readable media in the form of volatile memory, such as RAM and/or cache memory or others. The computer system (e.g., 4000) may further include other removable/non-removable, volatile/non-volatile computer system storage media.

The computer system (e.g., 4000) may communicate with one or more devices using the network adapter (e.g., 4050). The network adapter may support wired communications based on Internet, local area network (LAN), wide area network (WAN), or the like, or wireless communications based on code division multiple access (CDMA), global system for mobile communication (GSM), wideband CDMA, CDMA-2000, time division multiple access (TDMA), long term evolution (LTE), wireless LAN, Bluetooth, Zig Bee, or the like.

Exemplary embodiments of the present disclosure may include a system, a method, and/or a non-transitory computer readable storage medium. The non-transitory computer readable storage medium (e.g., the memory system 4030) has computer readable program instructions thereon for causing a processor to carry out aspects of the present disclosure.

The computer readable storage medium can be a tangible device that can retain and store instructions for use by an instruction execution device. The computer readable storage medium may be, for example, but not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EEPROM or Flash memory), a static random access memory (SRAM), a portable compact disc read-only memory (CD-ROM), a digital versatile disk (DVD), a memory stick, a floppy disk, or the like, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to the computing system 4000 from the computer readable storage medium or to an external computer or external storage device via a network. The network may include copper transmission cables, optical transmission fibers, wireless transmission, routers, firewalls, switches, gateway computers and/or edge servers. A network adapter card (e.g., 4050) or network interface in each computing/processing device receives computer readable program instructions from the network and forwards the computer readable program instructions for storage in a computer readable storage medium within the computing system.

Computer readable program instructions for carrying out operations of the present disclosure may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the computing system (e.g., 4000) through any type of network, including a LAN or a WAN, or the connection may be made to an external computer (for example, through the Internet using an Internet Service Provider). In an exemplary embodiment, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present disclosure.

Aspects of the present disclosure are described herein with reference to flowchart illustrations and/or block diagrams of methods, system (or device), and computer program products (or computer readable medium). It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general-purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present disclosure. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The corresponding structures, materials, acts, and equivalents of all means or step plus function elements, if any, in the claims below are intended to include any structure, material, or act for performing the function in combination with other claimed elements as specifically claimed. The description of the present disclosure has been presented for purposes of illustration and description but is not intended to be exhaustive or limited to the present disclosure in the form disclosed. Many modifications and variations will be apparent to those of ordinary skill in the art without departing from the scope and spirit of the present disclosure. The embodiment was chosen and described in order to best explain the principles of the present disclosure and the practical application, and to enable others of ordinary skill in the art to understand the present disclosure for various embodiments with various modifications as are suited to the particular use contemplated.

While the present invention has been particularly shown and described with respect to preferred embodiments thereof, it will be understood by those skilled in the art that the foregoing and other changes in forms and details may be made without departing from the spirit and scope of the present invention. It is therefore intended that the present invention not be limited to the exact forms and details described and illustrated but fall within the scope of the appended claims.

What is claimed is:

1. A noise cancellation system for a vehicle, comprising:

a controller configured to:

determine a waveform of a first sound wave at a first location;

calculate another waveform of the first sound wave at a second location of an operator based on the waveform of the first sound wave at the first location and a first distance between the first location and the second location;

generate at least one control signal based on the determined another waveform of the first sound wave at the second location; and at least one sound generator positioned at a third location, configured to:

generate a second sound wave based on the at least one control signal, a waveform of the second sound wave being formed to cancel out the first sound wave at the second location, wherein the first sound wave is generated by a noise source, wherein the controller is further configured to:

determine an angle at which the first sound wave enters into a cabin of the vehicle through a surface;

calculate the another waveform of the first sound wave at the second location based on the determined angle, wherein when the determined angle gets closer to 90 degrees with respect to the surface of the vehicle, the amplitude of the first sound wave after passing through the surface of the vehicle becomes increased, and wherein when the determined angle gets farther away from the 90 degrees with respect to the surface of the vehicle, the amplitude of the first sound wave after passing through the surface of the vehicle becomes decreased.

2. The system of claim 1, wherein the noise source is positioned outside the vehicle.

3. The system of claim 1, further comprising:

memory storing information of the waveform of the first sound wave at the first location.

4. The system of claim 1; wherein the noise source is positioned at the first location.

5. The system of claim 4, further comprising a sound receiver positioned at the first location or in the vicinity of the first location, configured to detect the first sound wave at the first location.

6. The system of claim 1, wherein the noise source is positioned at a fourth location different from the first location, and wherein the first sound wave travels from the fourth location to the second location via the first location.

7. The system of claim 6, wherein the first location is positioned on a direct path of the first sound wave from the fourth location to the second location.

8. The system of claim 1, wherein the controller is configured to generate the at least one control signal further based on a second distance between the third location and the second location.

9. The system of claim 1, wherein at the second location, the phase of the second sound wave is opposite to the first sound wave.

10. The system of claim 6, further comprising:

a space scanning device configured to scan a layout of an interior of the vehicle and transmit information of the scanned layout to the controller, wherein the controller is configured to determine the second location, the third location, and the fourth location based on the information of the scanned layout, and wherein the third location and the fourth location are positioned inside the vehicle.

11. The system of claim 10, further comprising:

memory storing information of the angle at which the first sound wave enters into the cabin of the vehicle through the surface.

12. A noise cancellation system for a vehicle, comprising:

a controller configured to:

determine a waveform of a first sound wave at a first location;

calculate another waveform of the first sound wave at a second location of an operator based on the waveform of the first sound wave at the first location and a first distance between the first location and the second location;

generate at least one control signal based on the determined another waveform of the first sound wave at the second location; and at least one sound generator positioned at a third location, configured to:

generate a second sound wave based on the at least one control signal, a waveform of the second sound wave being formed to cancel out the first sound wave at the second location, wherein the first sound wave is generated by a noise source, wherein the first sound wave at the second location comprises a directly transmitted portion and a reflected portion, wherein the directly transmitted portion corresponds to the first sound wave transmitted directly from the first location without being reflected off a surface of the vehicle, and the reflected portion corresponds to the first sound wave reflected off at least one surface of the vehicle, wherein the at least one control signal comprises a first control signal and a second control signal, wherein a portion of the second sound wave is generated based on the first control signal to cancel out the directly transmitted portion, and another portion of the second sound wave is generated based on the second control signal to cancel out the reflected portion.

13. The system of claim 12, wherein the first control signal is generated based on the first distance, and the second control signal is generated based on a distance of the travel path of the reflected portion of the second sound wave.

14. A noise cancellation method for a vehicle, comprising:

determining; by a controller, a waveform of a first sound wave at a first location;

calculating, by the controller, another waveform of the first sound wave at a second location of an operator based on the waveform of the first sound wave at the first location and a first distance between the first location and the second location;

generating, by the controller, at least one control signal based on the determined another waveform of the first sound wave at the second location; and generating, by a sound generator positioned at a third location, a second sound wave based on the at least one control signal, wherein a waveform of the second sound wave are formed to cancel out the first sound wave at the second location, and wherein the first sound wave is generated by a noise source;

wherein the generating at least one control signal based on the determined another waveform of the first sound wave at the second location comprises:

determining an angle at which the first sound wave enters into a cabin of the vehicle through a surface;

calculating the another waveform of the first sound wave at the second location based on the determined angle, wherein when the determined angle gets closer to 90 degrees with respect to the surface of the vehicle, the amplitude of the first sound wave after passing through the surface of the vehicle becomes increased, and wherein when the determined angle gets farther away from the 90 degrees with respect to the surface of the vehicle, the amplitude of the first sound wave after passing through the surface of the vehicle becomes decreased.

15. The method of claim 14, wherein the waveform of a first sound wave at a first location is determined by at least one of:

reading, by the controller, information of the waveform of the first sound wave at the first location from memory; and detecting the first sound wave using a sound receiver positioned at a fourth location.

16. The method of claim 15, herein the fourth location is the same as or in vicinity of the first location.

17. The method of claim 15, wherein the fourth location is positioned inside the vehicle and is different from the first location.

18. The method of claim 15, wherein the at least one control signal is generated further based on a second distance between the third location and the second location.

19. The method of claim 15, wherein at the second location, the phase of the second sound wave is opposite to the first sound wave.

20. A non-transitory computer-readable storage medium having computer readable program instructions, the computer readable program instructions read and executed by at least one processor for performing a method for noise cancellation in a vehicle, the method comprises: determining a waveform of a first sound wave at a first location; calculating another waveform of the first sound wave at a second location of an operator based on the waveform of the first sound wave at the first location and a first distance between the first location and the second location; generating at least one control signal based on the determined another waveform of the first sound wave at the second location, and generating, using a sound generator positioned at a third location, a second sound wave based on the at least one control signal, wherein a waveform of the second sound wave are formed to cancel out the first sound wave at the second location, and wherein the first sound wave is generated by a noise source, wherein the generating at least, one control signal based on the determined another waveform of the first sound wave at the second location comprises: determining an angle at which the first sound wave enters into a cabin of the vehicle through a surface; calculating the another waveform of the first sound wave at the second location based on the determined angle, wherein when the determined angle gets closer to 90 degrees with respect to the surface of the vehicle, the amplitude of the first sound wave after passing through the surface of the vehicle becomes increased, and wherein when the determined angle gets farther away from the 90 degrees with respect to the surface of the vehicle, the amplitude of the first sound wave after passing through the surface of the vehicle becomes decreased.

21. The storage medium of claim 20, wherein the characteristics of a first sound wave at a first location is determined by at least one of:

reading, by the controller, information of the characteristics of the first sound wave at the first location from memory; and detecting the first sound wave using a sound receiver positioned at a fourth location.

22. The storage medium of claim 21, wherein the fourth location is the same as or in vicinity of the first location.

23. The storage medium of claim 21, wherein the fourth location is positioned inside the vehicle and is different from the first location.

24. The storage medium of claim 21, wherein the at least one control signal is generated further based on a second distance between the third location and the second location.

25. The storage medium of claim 20, wherein at the second location, the phase of the second sound wave is opposite to the first sound wave.

* * * * *